US010082033B2

(12) United States Patent
Spangler

(10) Patent No.: US 10,082,033 B2
(45) Date of Patent: Sep. 25, 2018

(54) GAS TURBINE BLADE WITH PLATFORM COOLING

(71) Applicant: United Technologies Corporation, Farmington, CT (US)

(72) Inventor: Brandon W. Spangler, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 306 days.

(21) Appl. No.: 14/993,765

(22) Filed: Jan. 12, 2016

(65) Prior Publication Data

US 2017/0198588 A1 Jul. 13, 2017

(51) Int. Cl.

| | |
|---|---|
| ***F01D 5/18*** | (2006.01) |
| ***F01D 9/02*** | (2006.01) |
| ***F01D 25/12*** | (2006.01) |

(52) U.S. Cl.

CPC ..... *F01D 5/186* (2013.01); *F01D 9/02* (2013.01); *F01D 25/12* (2013.01); *F05D 2220/32* (2013.01); *F05D 2230/60* (2013.01); *F05D 2240/81* (2013.01); *F05D 2260/202* (2013.01)

(58) Field of Classification Search

CPC ..... F01D 5/186; F01D 25/12; F05D 2230/31; F05D 2240/81; F05D 2260/202

See application file for complete search history.

(56) References Cited

U.S. PATENT DOCUMENTS

| | | | | |
|---|---|---|---|---|
| 7,131,817 | B2 * | 11/2006 | Keith | F01D 5/081 416/97 R |
| 8,636,470 | B2 * | 1/2014 | Halfmann | F01D 5/3015 416/193 A |
| 8,641,368 | B1 * | 2/2014 | Liang | F01D 5/186 415/115 |
| 9,617,920 | B2 * | 4/2017 | Headland | F01D 9/041 |
| 2006/0269409 | A1 * | 11/2006 | Torii | F01D 5/187 416/97 R |

FOREIGN PATENT DOCUMENTS

| | | |
|---|---|---|
| EP | 1028228 A1 | 8/2000 |
| EP | 1621726 A2 | 2/2006 |
| EP | 2787170 A1 | 10/2014 |

OTHER PUBLICATIONS

EP1028228 English Machine Translation.
EP1028228 English Abstract.
European Search Report for Application No. EP 17151256.

* cited by examiner

*Primary Examiner* — Ninh H Nguyen
(74) *Attorney, Agent, or Firm* — Cantor Colburn LLP

(57) ABSTRACT

A component for a gas turbine engine is provided. The component having: a platform secured to the component, the platform having an exterior surface in fluid communication with an internal cooling pocket of the platform via a plurality of cooling openings located in the platform; a channel in fluid communication with the internal cooling pocket; an internal cooling cavity in fluid communication with the channel via a feed opening extending through an internal wall of the component, wherein a portion of the channel and the feed opening are located below the internal cooling pocket; and a cover plate sealing the internal cooling pocket and the channel.

19 Claims, 14 Drawing Sheets

GAS TURBINE BLADE WITH PLATFORM COOLING

BACKGROUND

This disclosure relates generally to gas turbine engines and, more particularly, to cooling techniques for the airfoil sections of turbine blades of the engine. In particular, the present application is directed to cooling techniques for blade platforms.

In general, gas turbine engines are built around a power core comprising a compressor, a combustor and a turbine, which are arranged in flow series with a forward (upstream) inlet and an aft (downstream) exhaust. The compressor compresses air from the inlet, which is mixed with fuel in the combustor and ignited to produce hot combustion gases. The hot combustion gases drive the turbine section, and are exhausted with the downstream flow.

The turbine drives the compressor via a shaft or a series of coaxially nested shaft spools, each driven at different pressures and speeds. The spools employ a number of stages comprised of alternating rotor blades and stator vanes. The vanes and blades typically have airfoil cross sections, in order to facilitate compression of the incoming air and extraction of rotational energy in the turbine. The blades are secured to the rotor disk through a blade platform.

High combustion temperatures also increase thermal and mechanical loads, particularly on turbine airfoils and associated platforms downstream of the combustor. This reduces service life and reliability, and increases operational costs associated with maintenance and repairs.

Blade platforms have been passively cooled by leakage air in a large plenum or a few filmholes, resulting in low backside heat transfer coefficients and high metal temps. Small cooling chambers are required to adequately cool the platform. However, these small chambers result in the feed holes that supply cooling air to these chambers being located in an area of the blade neck that is difficult to drill and has high stress due to the platform centrifugal loads.

Accordingly, it is desirable to provide cooling to the blade platforms in an efficient manner.

BRIEF DESCRIPTION

In one embodiment, a component for a gas turbine engine is provided. The component having: a platform secured to the component, the platform having an exterior surface in fluid communication with an internal cooling pocket of the platform via a plurality of cooling openings located in the platform; a channel in fluid communication with the internal cooling pocket; an internal cooling cavity in fluid communication with the channel via a feed opening extending through an internal wall of the component, wherein a portion of the channel and the feed opening are located below the internal cooling pocket; and a cover plate sealing the internal cooling pocket and the channel.

In addition to one or more of the features described above, or as an alternative to any of the foregoing embodiments, the another portion of the channel may be located within a ledge that is located in an internal periphery of the internal cooling pocket.

In addition to one or more of the features described above, or as an alternative to any of the foregoing embodiments, the cover plate may be secured to the ledge.

In addition to one or more of the features described above, or as an alternative to any of the foregoing embodiments, a pair of ribs may extend from the ledge and wherein the portion of the channel is also located between the pair of ribs and the feed opening is located between the pair of ribs.

In addition to one or more of the features described above, or as an alternative to any of the foregoing embodiments, the cover plate further includes a first cover plate portion secured to the ledge and a second cover plate portion secured below the ledge.

In addition to one or more of the features described above, or as an alternative to any of the foregoing embodiments, the feed opening may have an oblong or circular configuration.

In addition to one or more of the features described above, or as an alternative to any of the foregoing embodiments, the second cover plate portion may have at least one "L" shaped configuration.

In addition to one or more of the features described above, or as an alternative to any of the foregoing embodiments, the cover plate may have a first cover plate portion secured to the ledge and a second cover plate portion secured to the pair of ribs.

In addition to one or more of the features described above, or as an alternative to any of the foregoing embodiments, the second cover plate portion may be a separate cover plate not integrally formed to the first cover plate portion.

In addition to one or more of the features described above, or as an alternative to any of the foregoing embodiments, the cover plate further includes a first cover plate secured to the ledge and a second cover plate secured below the ledge, wherein the second cover plate forms the another portion of the channel.

In addition to one or more of the features described above, or as an alternative to any of the foregoing embodiments, the feed opening may be located below the ledge and is covered by the second cover plate portion.

In addition to one or more of the features described above, or as an alternative to any of the foregoing embodiments, the channel may be located in the internal wall and wherein the cover plate comprises a first cover plate portion secured to the ledge and a second cover plate portion secured to the internal wall below the ledge.

In addition to one or more of the features described above, or as an alternative to any of the foregoing embodiments, the channel may be formed by the second cover plate portion.

In yet another embodiment, a blade for a gas turbine engine is provided, the blade having: an airfoil; a platform secured to the airfoil, the platform having an exterior surface located adjacent to the airfoil in fluid communication with an internal cooling pocket of the platform via a plurality of cooling openings located in the platform; a channel in fluid communication with the internal cooling pocket; an internal cooling cavity of the airfoil in fluid communication with the channel via a feed opening extending through an internal wall of the airfoil; and a cover plate sealing the internal cooling pocket and the channel, wherein cooling fluid in the internal cooling cavity must pass through the feed opening and the channel prior to entering the internal cooling pocket.

In addition to one or more of the features described above, or as an alternative to any of the foregoing embodiments, the channel may be located within a ledge that is located in an internal periphery of the internal cooling pocket.

In addition to one or more of the features described above, or as an alternative to any of the foregoing embodiments, the channel may extend below the ledge and wherein the cover plate comprises a first cover plate portion secured to the ledge to seal the internal cooling pocket and a second cover plate portion secured below the ledge to seal the channel.

In addition to one or more of the features described above, or as an alternative to any of the foregoing embodiments, the feed opening may be located below the ledge and has an oblong or circular configuration, and wherein the feed opening is covered by the second cover plate portion.

In addition to one or more of the features described above, or as an alternative to any of the foregoing embodiments, the first cover plate may be recessed from an edge of the platform rail and wherein a blade-to-blade seal sits against the edge of the platform rail.

In yet another embodiment a gas turbine engine is provided. The engine having: an airfoil; a platform secured to the airfoil, the platform having an exterior surface located adjacent to the airfoil in fluid communication with an internal cooling pocket of the platform via a plurality of cooling openings located in the platform; a channel in fluid communication with the internal cooling pocket; an internal cooling cavity of the airfoil in fluid communication with the channel via a feed opening extending through an internal wall of the airfoil; and a cover plate sealing the internal cooling pocket and the channel, wherein cooling fluid in the internal cooling cavity must pass through the feed opening and the channel prior to entering the internal cooling pocket.

In still yet another embodiment, a method of forming a cooling path in a blade of a gas turbine engine is provided. The method including the steps of: fluidly coupling the exterior surface of the platform to an internal cooling pocket located below the platform via a plurality of openings in the platform; fluidly coupling the internal cooling pocket to a feed opening located in an internal wall of the blade via a channel extending through a ledge of the internal cooling pocket, wherein the feed opening is in fluid communication with an internal cooling cavity of the airfoil; and securing a cover plate to the ledge.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Various embodiments of the present disclosure are related to cooling techniques for airfoil sections of gas turbine components such as vanes or blades of the engine. In particular, the present application is directed to cooling techniques for blade platforms.

Figure 1:
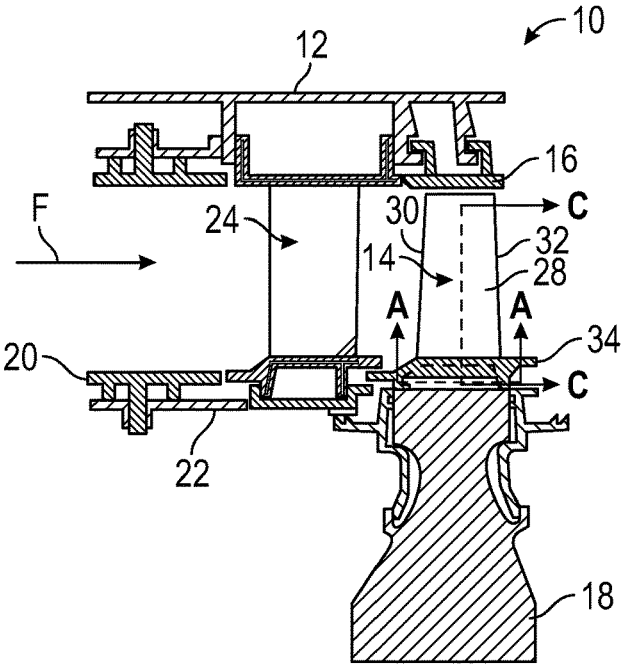
FIG. 1 is a cross-sectional view of a portion of a gas turbine engine.

FIG. 1 is a cross-sectional view of a portion of a gas turbine engine 10 wherein various components of the engine 10 are illustrated. These components include but are not limited to an engine case 12, a rotor blade 14, a blade outer air seal (BOAS) 16, a rotor disk 18, a combustor panel 20, a combustor liner 22 and a vane 24. As mentioned above, rotor blade or component 14 is subjected to high thermal loads due to it being located downstream of a combustor of the engine 10. Thus, it is desirable to provide cooling to the airfoils of the engine.

In order to provide cooling air to the blade 14 and as illustrated in the attached FIGS., a plurality of cooling openings or cavities 26 are formed within an airfoil 28 of the blade 14. The cooling openings or cavities 26 are in fluid communication with a source of cooling air so that thermal loads upon the blade 14 can be reduced. In one non-limiting example, the cooling air is provided from a compressor section of the gas turbine engine. In turbofan embodiments, the cooling fluid may be provided from a compressed air source such as compressor bleed air. In ground-based industrial gas turbine embodiments, other fluids may also be used.

Figure 2A:
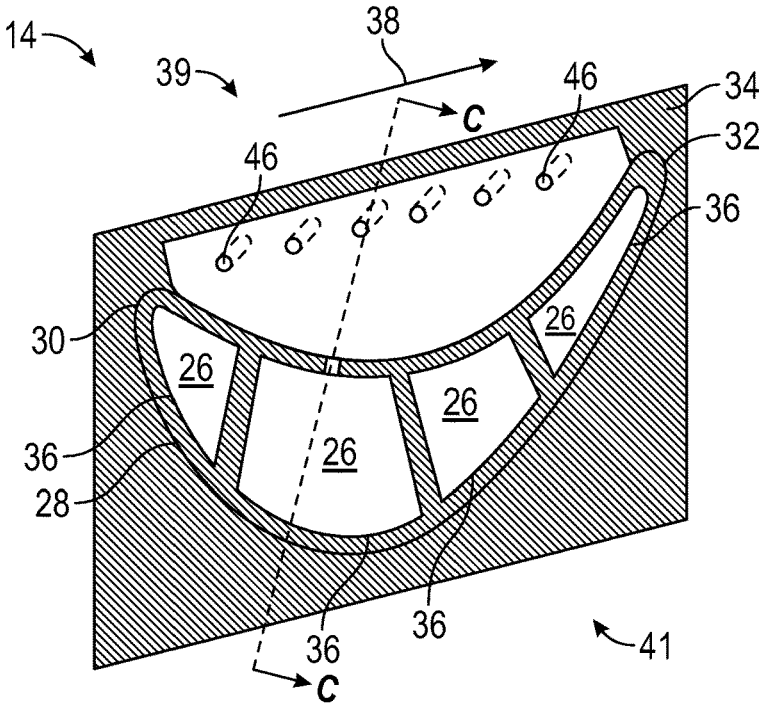
FIG. 2A is a view of an airfoil along lines A-A of FIG. 1.
Figure 2B:
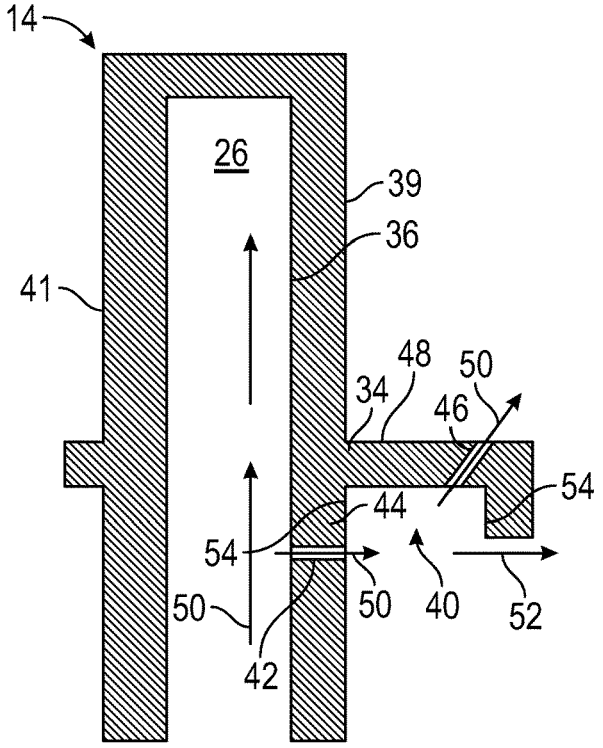
FIG. 2B is a view of the airfoil of FIG. 2A along lines C-C of FIG. 2A.

The airfoil 28 extends axially between a leading edge 30 and a trailing edge 32 and radially from a platform 34. The internal cooling passages 26 are defined along internal surfaces 36 of the airfoil section 28, as seen at least in FIGS. 2A and 2B. The airfoil 28 is exposed to a generally axial flow of combustion gas F, which flows across airfoil section 28 from leading edge 30 to trailing edge 32, resulting in a high gas path pressure to a low gas path pressure in the direction of arrow 38.

In order to provide a source of cooling to the platform 34 of the airfoil 28, an open pocket 40 is formed below a portion of the platform 34 proximate to a pressure side 39 of the airfoil 28, which is opposite to a suction side 41 of the airfoil 28. The pocket 40 is in fluid communication with a source of cooling air provided to at least one of the internal cooling passages 26 via a feed opening 42 that extends through an internal wall or neck 44 of the blade 14. In addition, the platform 34 is provided with a plurality of cooling openings or film holes 46 that extend through the platform such that cooling air may be provided to an exterior surface 48 of the platform via cooling openings or film holes 46, pocket 40, and feed opening 42. This cooling is illustrated by arrows 50. However, having a large open pocket 40 may result in low heat transfer coefficients as some of the cooling air is lost due to leakage as illustrated by arrow 52. In other words, some air may be sent through cooling openings 46 while some is lost due to leakage. Although pocket 40 is illustrated proximate to the pressure side 39 of the airfoil 28, it is also understood that various alternative embodiments of the disclosure contemplate the pocket being located proximate to the suction side 41 of the airfoil 28 or a pair of pockets 40 proximate to both the pressure and suction side of the airfoil may be provided.

Figure 3:
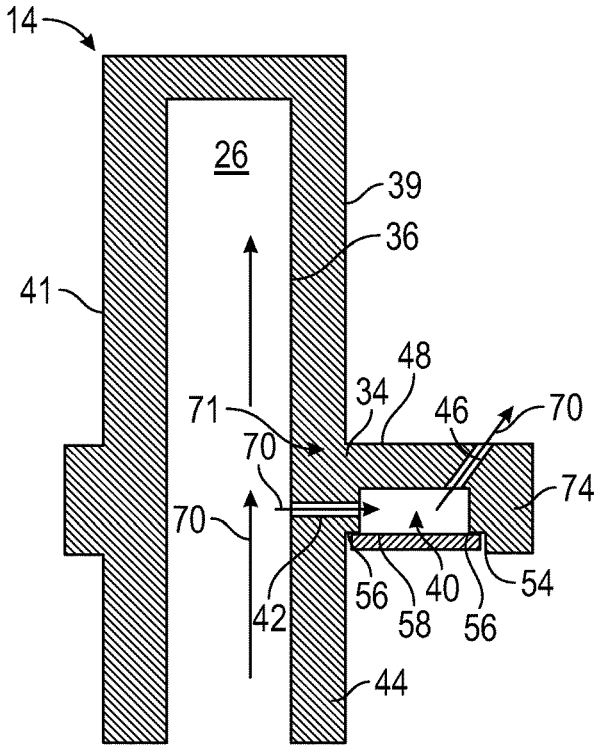
FIG. 3 is a cross-sectional view of an airfoil vane according to an embodiment of the present disclosure along lines C-C of FIG. 1.

Referring now to FIG. 3 and in order to direct all of the cooling air received from the feed opening or hole 42, at least a portion of an internal periphery 54 of the pocket 40 is configured to have rib or ledge 56 and feed opening 42 is formed through ledge 56. In one embodiment, the rib or ledge 56 may be cast, additively manufactured with the blade or components thereof. Rib or ledge 56 allows a cover plate 58 to be secured thereto by welding or any other equivalent processes in order to seal pocket 40 and thus direct all of the cooling air from feed opening 42 into sealed pocket 40 and then to cooling openings or film holes 46 as illustrated by arrows 70 in at least FIG. 3. In one embodiment, rib or ledge 56 may extend along the entire internal periphery 54 of the pocket 40.

While the cover plate 58 creates a smaller enclosed pocket 40, which results in higher heat transfer coefficients, the feed hole 42 is located proximate to the blade neck or interface with the platform 34, which is identified generally by arrow 71. This area is generally an area of high stress due to high centrifugal loads and accordingly it may be desirable to move the feed hole 42 away from this area or further downwardly from the platform 34 by moving it lower with respect to the view of FIG. 3.

Figure 4:
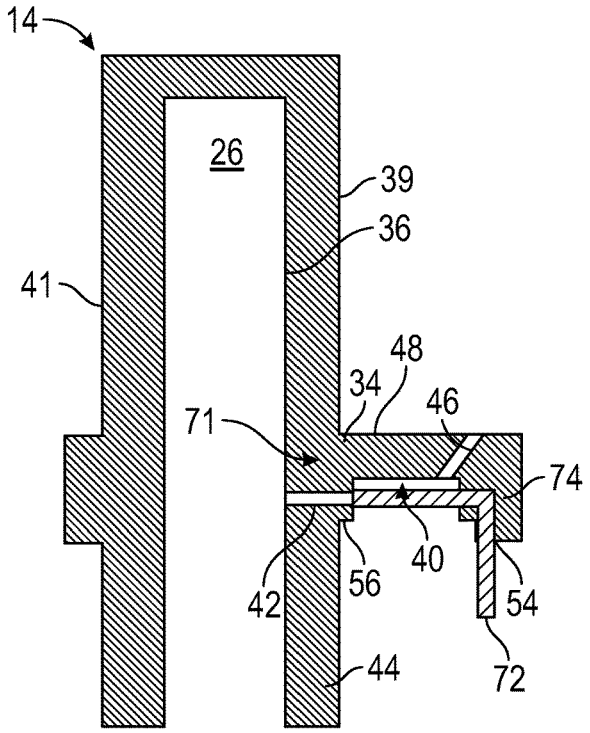
FIG. 4 is a cross-sectional view of an airfoil vane according to an embodiment of the present disclosure along lines C-C of FIG. 1.
Figure 5A:
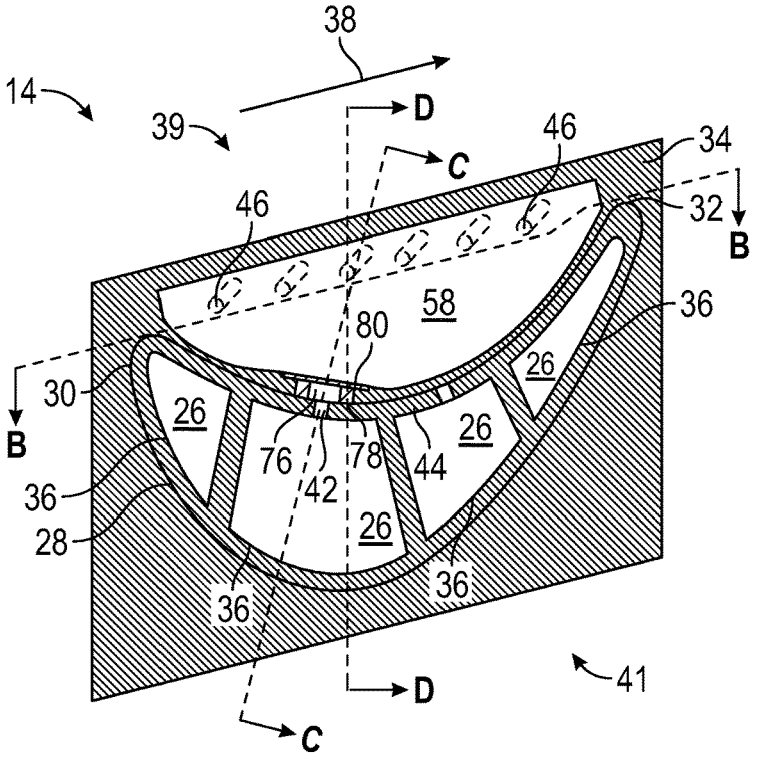
FIG. 5A is a view of an airfoil along lines A-A of FIG. 1, according to yet another embodiment of the present disclosure.
Figure 5B:
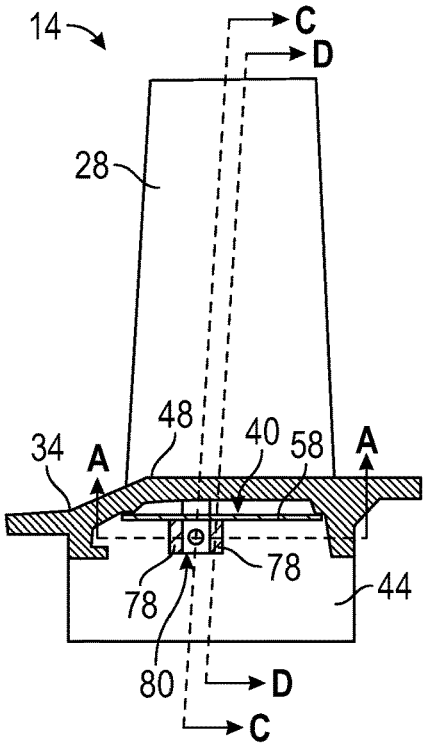
FIG. 5B is a view of the airfoil of FIG. 5A along lines B-B.
Figure 5C:
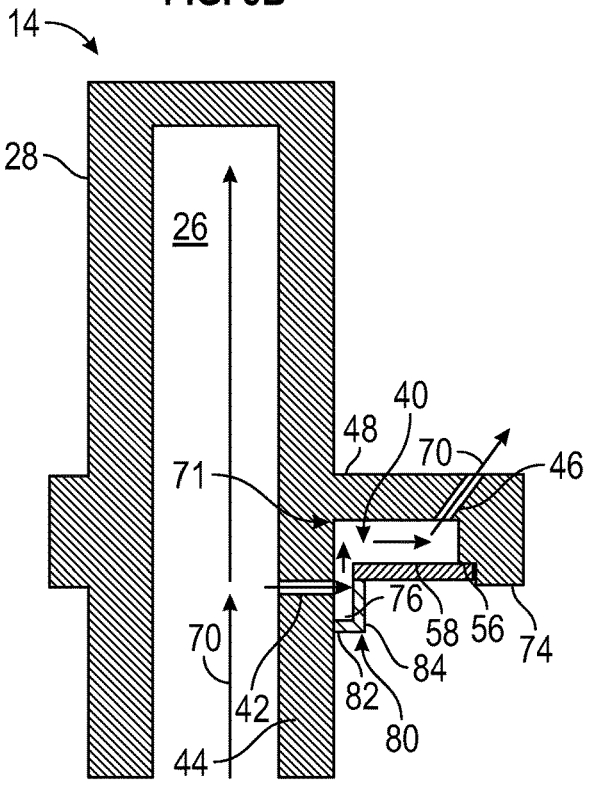
FIG. 5C is a view of the airfoil of FIG. 5A along lines C-C.
Figure 5D:
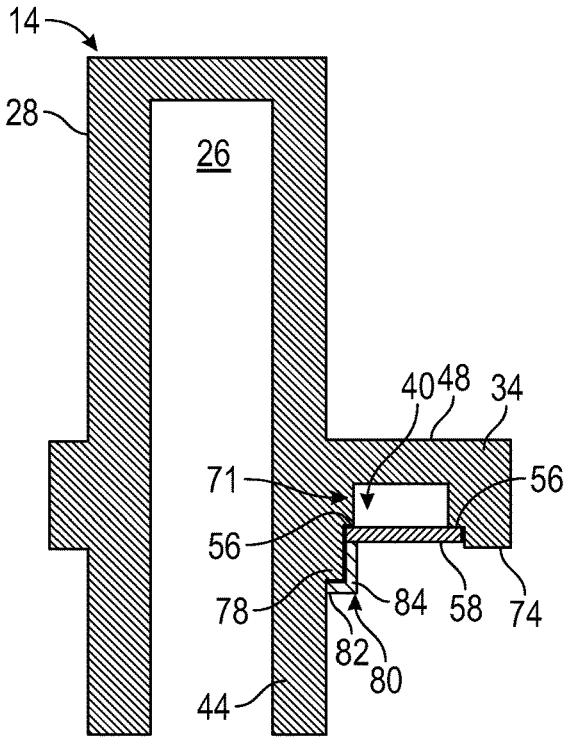
FIG. 5D is a view of the airfoil of FIG. 5A along lines D-D.
Figure 6A:
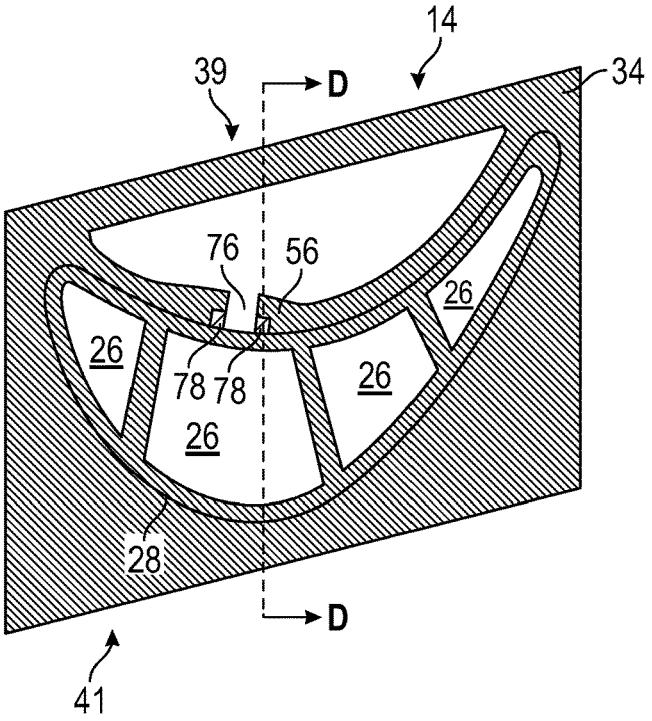
FIGS. 6A, 6B, 7A, 7B, 8A and 8B illustrate the manufacture of an airfoil according to one embodiment of the present disclosure.
Figure 6B:
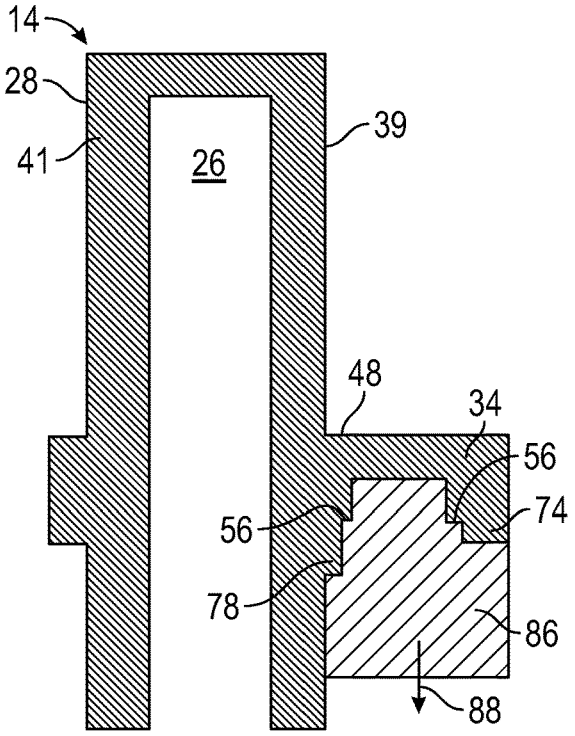
Figure 7A:
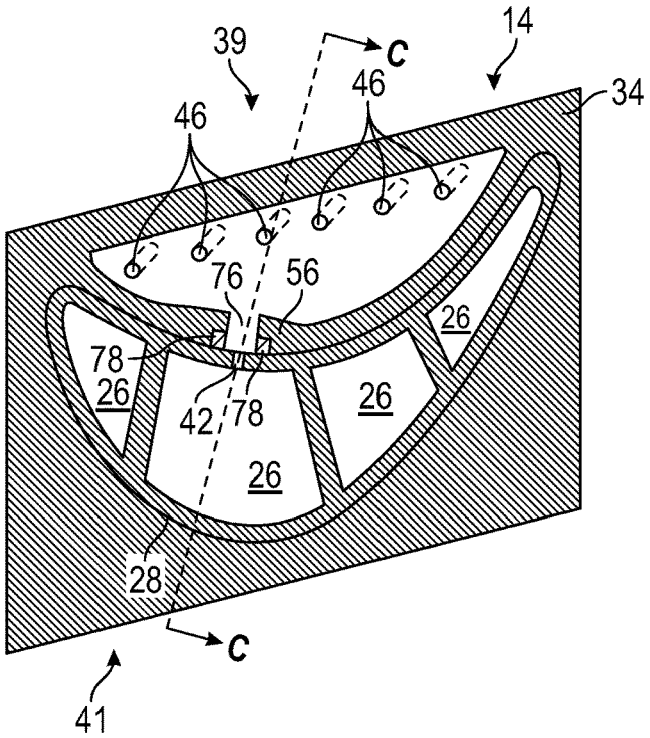
Figure 7B:
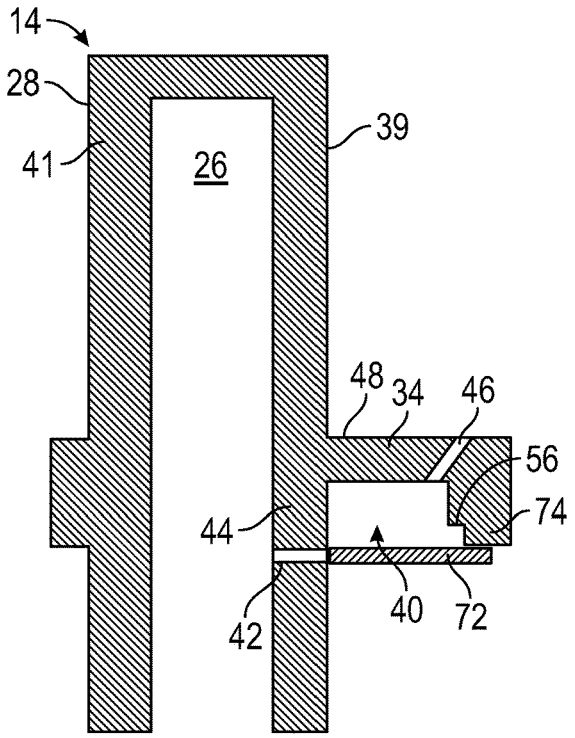

In addition and referring to FIG. 4, an electrode 72 for use in drilling or forming the feed hole 42 is illustrated. As shown, the electrode 72 may contact or interfere with the platform rail 74 when it is inserted into pocket 40 to form feed hole 42 in the location illustrated in FIG. 3. Therefore, in addition to the feed hole 42 being located in an area of high stress, it may also be difficult to form feed hole 42 in rib or ledge 56.

Referring now to FIGS. 5A-5D, another embodiment of the present disclosure is illustrated. In this embodiment, a portion of the rib or ledge 56 is configured to have an opening or channel 76 formed therein. In addition, a pair of ribs 78 are also provided. The pair of ribs 78 extend downwardly from the rib or ledge 56 on opposite sides of the opening or channel 76 such that the opening or channel 76 is also located between the pair of ribs 78. In one embodiment, the ribs or pair of ribs 78 may be cast or additively manufactured with the blade 14 or components thereof. In this embodiment, the feed opening 42 is formed between the ribs 78, which allows the feed opening 42 to be located lower in the neck 44 of the blade 14 so that the platform loads mentioned above are not interfacing with the feed opening 42.

Similar to the previous embodiment, the cover plate 58 is secured to enclose pocket 40. However, a second cover plate 80 is now applied to cover the channel 76. As illustrated in at least FIGS. 5C and 5D, the second cover plate 80 may be "L' shaped so that a horizontal portion 82 of the cover plate 80 covers the bottom of channel 76 and a vertical portion 84 of the cover plate 80 covers a vertical portion of the channel 76 located below cover plate 58. Of course, other configurations of the cover plate 80 are considered to be within the scope of various embodiments of the present disclosure. In one embodiment, cover plate 58 is secured to rib or ledge 56 first and the second cover plate 80 is secured the pair of ribs 78 afterwards. In one implementation, the second cover plate 80 may provide support to the first cover plate or cover plate 58.

Accordingly, the pair of ribs 78 which extend downwardly from rib or ledge 56 create a channel or chimney 76 that allows the feed hole 42 to be drilled at a lower radius from a center line of the engine 10 or further from the aforementioned blade neck interface with platform 34, such that there is more room to drill the hole and the stresses are lower. The vertical chimney ribs or pair of ribs 78 and cover plates 58 and 80 create a channel 76 that transports the cooling air from the feed hole 42 to the small cooling chamber 40 underneath the platform 34. In the illustrated embodiment, the rib or ledge 56 proximate to channel 76 extends further away from internal wall 44 than the pair of ribs 78 so that a portion of rib or ledge 56 remains for securement thereto by cover plate 58.

In one alternative embodiment, the cover plates 58 and 80 may be a single or one piece cover plate 58 with an integrally formed tab portion that has the same configuration of second cover plate 80 and thus, a single cover plate is contemplated for use in various embodiments of the disclosure.

Referring now to FIGS. 6A, 6B, 7A, 7B, 8A and 8B, a manufacturing process of the blade 14 is illustrated. As mentioned above, the blade 14 may be cast in accordance with known technologies, wherein a wax die 86 is employed to form pocket 40, ledge or rib 56, channel 76, and ribs 78. Once the blade 14 is formed, the wax die 86 is removed downwardly in the direction of arrow 88 without radial interference due to the configuration of the formed pocket 40, ledge or rib 56, channel 76, and ribs 78. Thereafter, the feed hole 42 is drilled in wall 44 via an electrode 72, which can be located below platform rail 74, thus allowing for ease of formation of feed hole opening 42 as well as locating it in channel 76 further from areas of high stress. During this step, the cooling openings 46 may also be formed using a similar process.

Figure 8A:
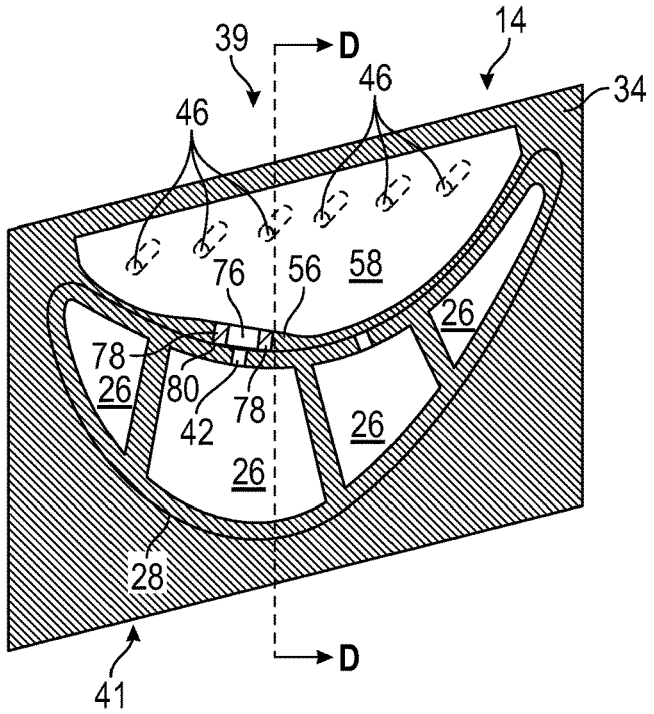
Figure 8B:
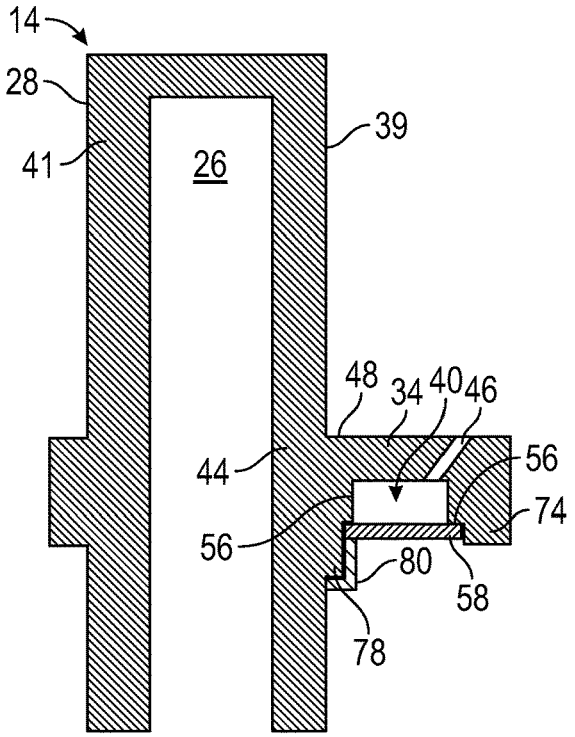
Figure 9A:
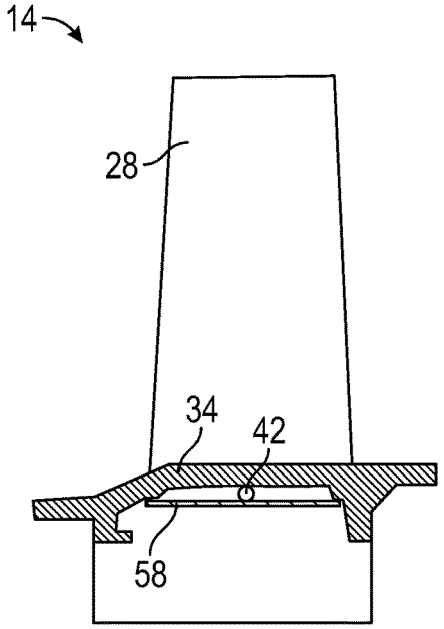
FIGS. 9A, 9B, 10A, 10B and 10C illustrate various configurations of feed hole openings and locations according to various embodiments of the present disclosure.
Figure 9B:
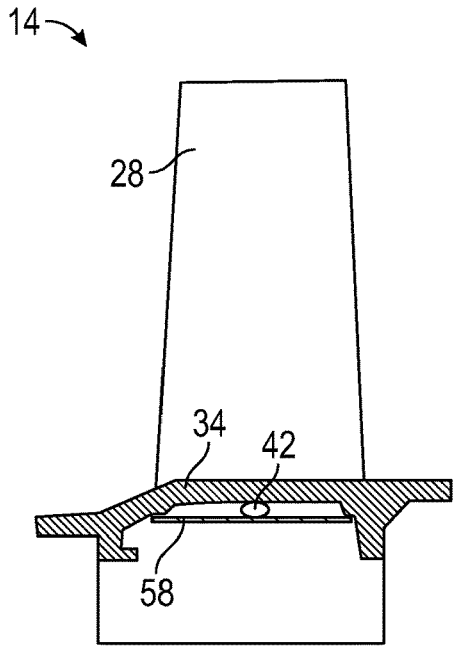

Thereafter and as illustrated in FIGS. 8A and 8B, the cover plates 58 and 80 are secured to the blade 14. As mentioned above, two separate cover plates may be employed or a single cover plate may be employed.

Figure 10A:
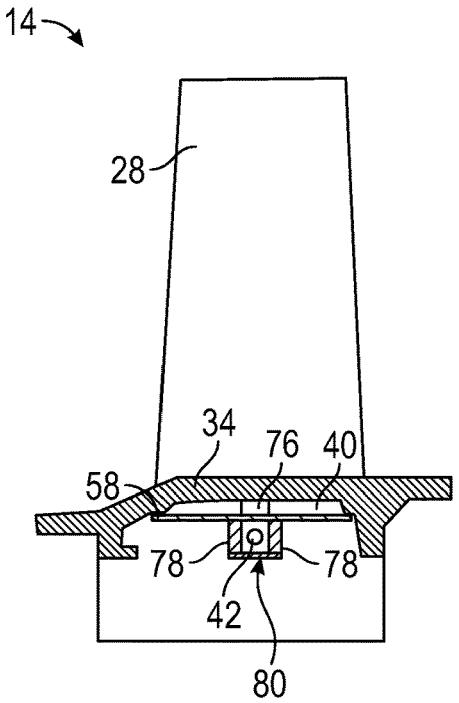
Figure 10B:
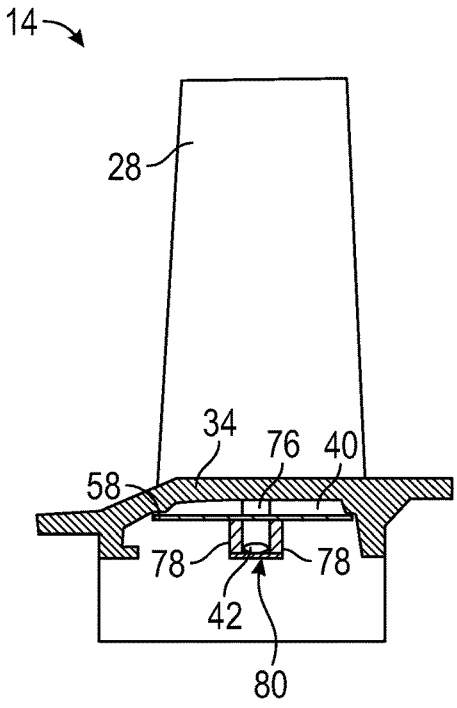
Figure 10C:
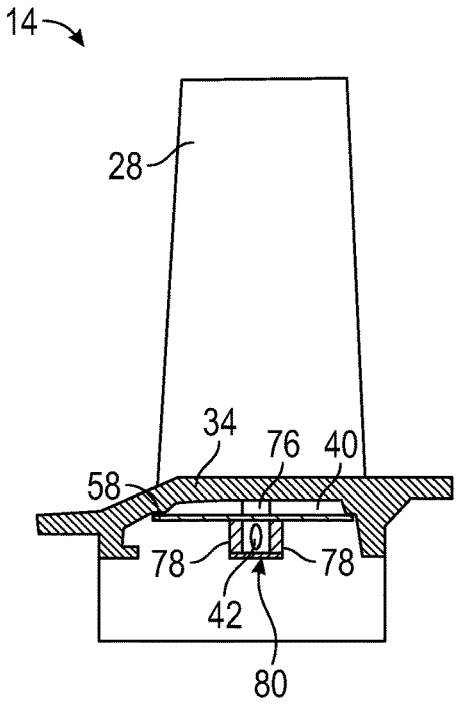

Referring now to FIGS. 9A, 9B, 10A, 10B and 10C, alternative configurations of the feed opening 42 are illustrated in accordance with some of the contemplated embodiments of the present disclosure. As illustrated, the opening 42 may be circular or round (FIGS. 9A and 10A) or the opening 42 may be oblong in an axial direction (FIGS. 9B and 10B), allowing for more clearance from rail 74 since the top of the hole 42 is lower than the circular or round hole illustrated in FIGS. 9A and 10A. An oblong hole may provide more flow area, but may be harder to form and thus may create more stress than the circular or round hole illustrated in FIGS. 9A and 10A. In still yet another embodiment and as illustrated in FIG. 10C, the oblong hole may be rotated 90 degrees and thus be referred to as a radial oblong hole. However, this configuration may have less clearance with respect to rail 74 since the top of the hole 42 is higher than that of the circular or round hole illustrated in FIGS. 9A and 10A and the axial oblong hole 42 illustrated in FIGS. 9B and 10B.

Figure 11A:
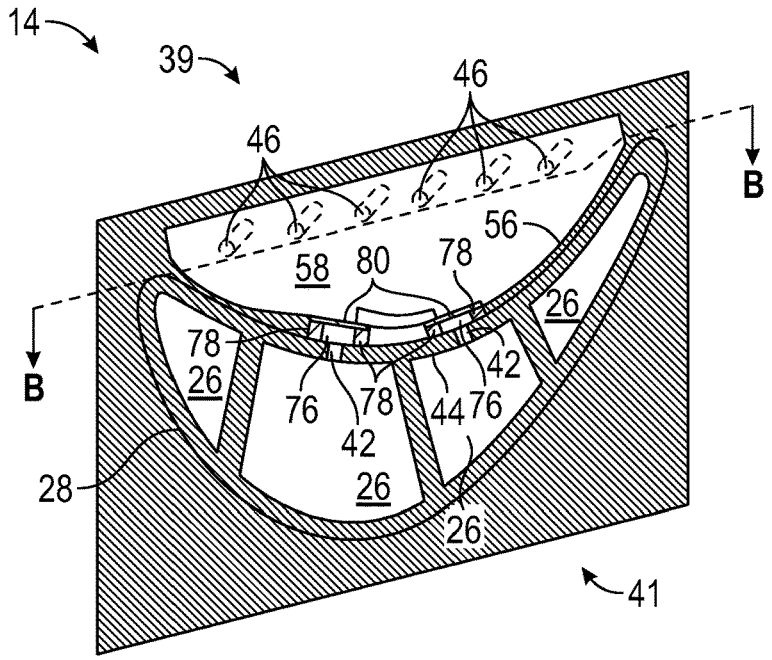
FIG. 11A is a view of an airfoil along lines A-A of FIGS. 1 and 11B according to yet another alternative embodiment of the present disclosure.
Figure 11B:
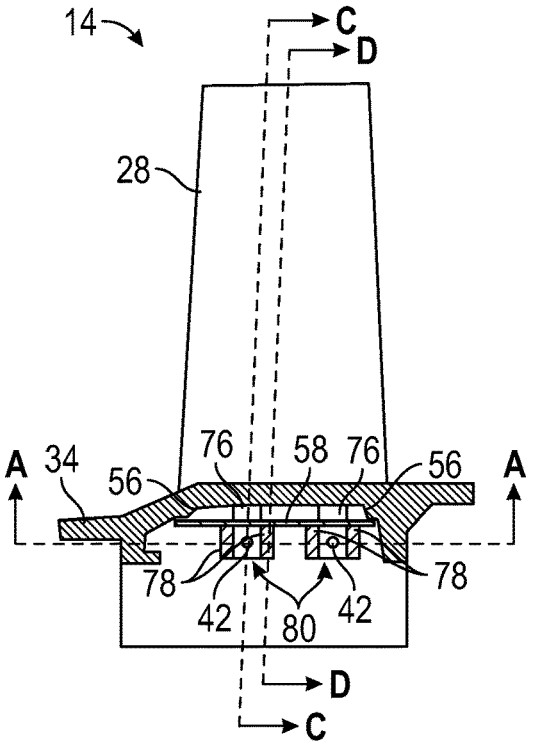
FIG. 11B is a view of the airfoil of FIG. 11A along lines B-B.

Referring now to FIGS. 11A and 11B, yet another alternative embodiment is illustrated. Here, at least two or a plurality of channels 76 are provided, each having a corresponding pair of ribs 78 and a feed hole 42 that is in fluid communication with a respective one of the plurality of internal cavities 26. Accordingly and in this embodiment, the two feed holes 42 and associated channels 76 provide a dual source of cooling air to the pocket 40 as well as cooling openings 46. Although two channels 76 are illustrated, it is, of course, understood that more than two channels 76 and associated feed hole 42 and ribs 78 may be provided. As in the previous embodiment, a second cover plate 80 is also provided for the second channel 76. As mentioned above, a first cover plate 58 may be employed and separate second cover plates 80 may be used to cover the channels 76. Alternatively, a single cover plate may be employed with tab sections that resemble the necessary configurations of the cover plates 80 in order to enclose the two channels 76 illustrated in FIGS. 11A and 11B.

Figure 12A:
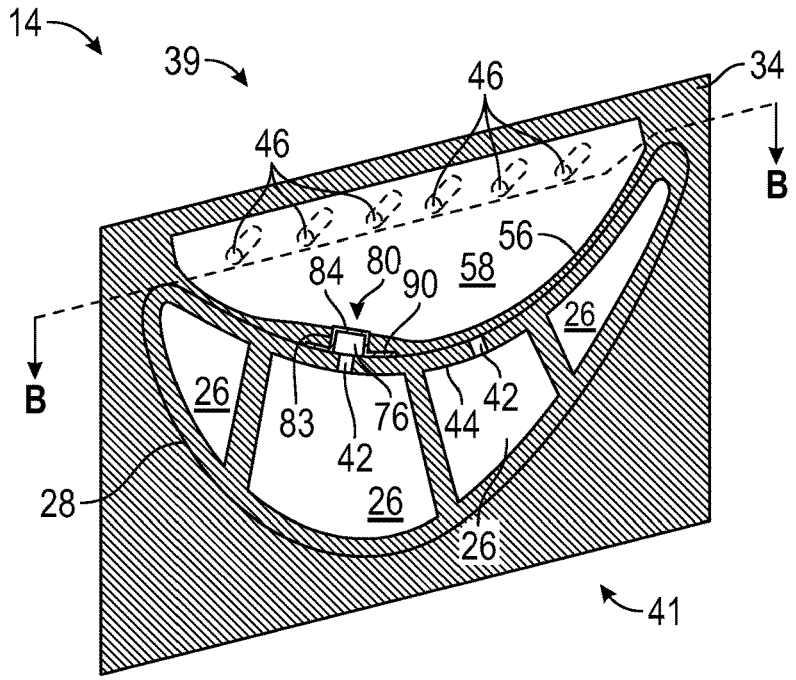
FIG. 12A is a view of an airfoil along lines A-A of FIGS. 1 and 12B according to yet another alternative embodiment of the present disclosure.
Figure 12B:
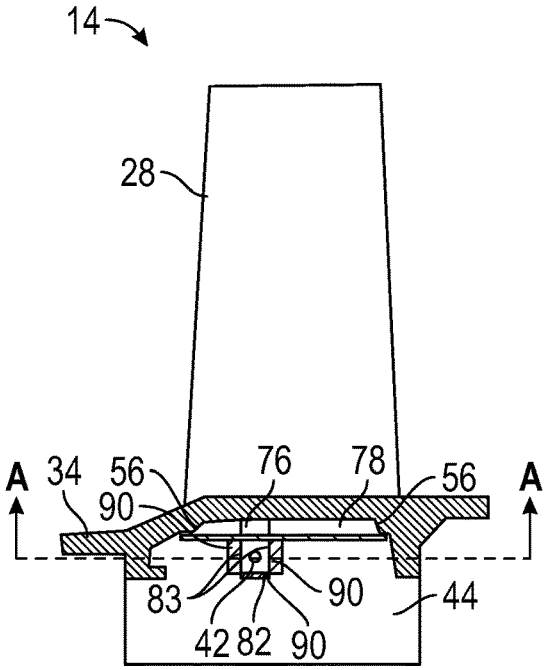
FIG. 12B is a view of the airfoil of FIG. 12A along lines B-B.

Referring now to FIGS. 12A and 12B, yet another alternative embodiment of the present disclosure is illustrated. In this embodiment, the pair of ribs 78 are eliminated and the channel 76 is located between rib or ledge 56. Here, the second cover plate 80 is configured to have two vertical wall portions 83 and a horizontal wall portion 82 that extend from vertical portion 84 and contact internal wall or neck 44 so that the second cover plate 80 itself forms the extension of channel 76 below rib or ledge 56 allowing for the opening 42 to be located below the rib or ledge 56 as mentioned above. In order to secure the second cover plate 80 of this embodiment to the internal wall or neck 44 via a welding step or any other suitable process, a plurality of flanges or tabs 90 are provided. The plurality of flanges or tabs 90 extend outwardly from the vertical wall portions 83 and horizontal wall portion 82 so that tabs or flanges 90 of the second cover plate 80 can be secured to internal wall or neck 44 and thus create the aforementioned channel extension that allows feed hole 42 to be located in a lower position on the internal wall or neck 44. As in the previous embodiments, the configuration of second cover plate 80 may be used separately from cover plate 58 or may comprise an integrally formed feature of a single cover plate. Still further and as discussed above, a single channel 76 with a single feed hole 42 may be provided or alternatively, a plurality of channels 76 (e.g., more than one) with corresponding feed holes 42 and cover plates 80 may also be provided.

Figure 13A:
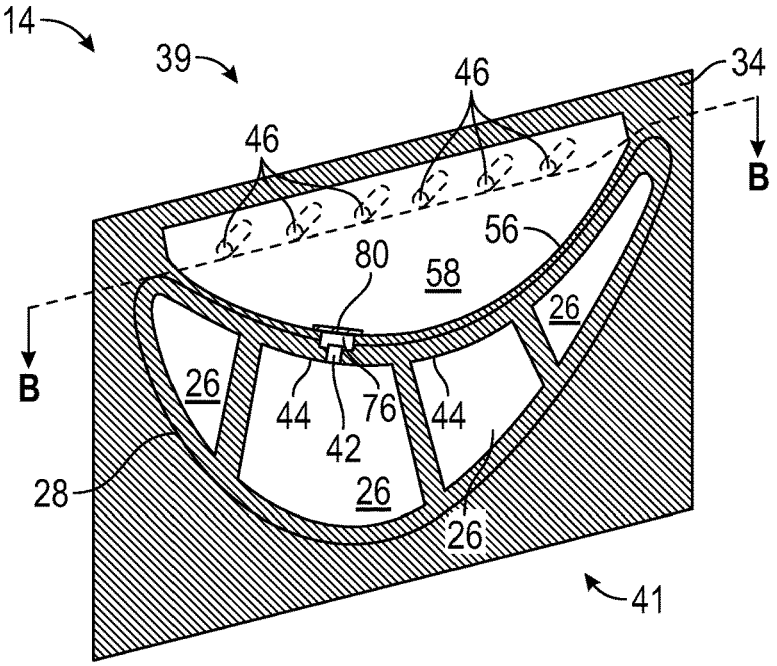
FIG. 13A is a view of an airfoil along lines A-A of FIGS. 1 and 13B according to still yet another alternative embodiment of the present disclosure.
Figure 13B:
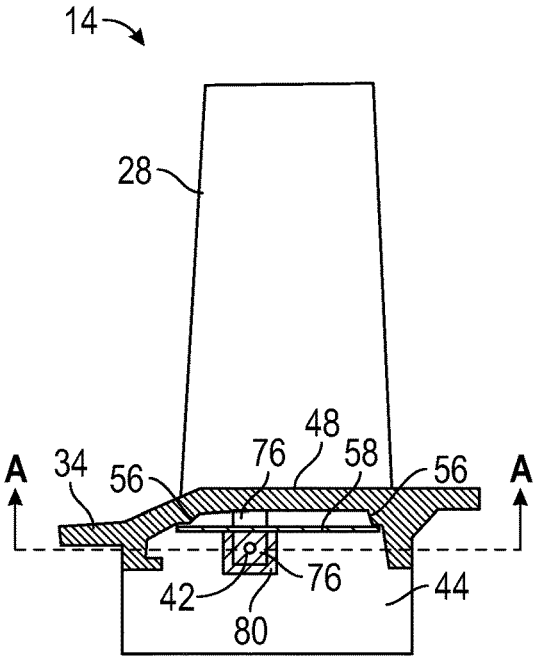
FIG. 13B is a view of the airfoil of FIG. 13A along lines B-B.

Referring now to FIGS. 13A and 13B, yet another alternative embodiment of the present disclosure is illustrated. In this embodiment, the channel 76 is formed in rib or ledge 56. However, the channel 76 is also formed in the surface of internal wall or neck 44 facing pocket 40. Still further, this channel 76 is configured to extend below rib or ledge 56 so that feed opening or hole 42 can be located in a position below platform rail 74 thus allowing for ease of formation of feed hole opening 42 as well as locating it in channel 76 further from areas of high stress. In this embodiment, the second cover plate 80 is simply a planar member configured to cover the portion of channel 76 that is located below rib or ledge 56 and is formed in the surface of internal wall or neck 44. As with the previous embodiments, the configuration of second cover plate 80 may be used separately from cover plate 58 or may comprise an integrally formed feature of a single cover plate. Still further and as discussed above, a single channel 76 with a single feed hole 42 may be provided or alternatively a plurality of channels 76 (e.g., more than one) with corresponding feed holes 42 and cover plates 80 may also be provided.

Figure 14:
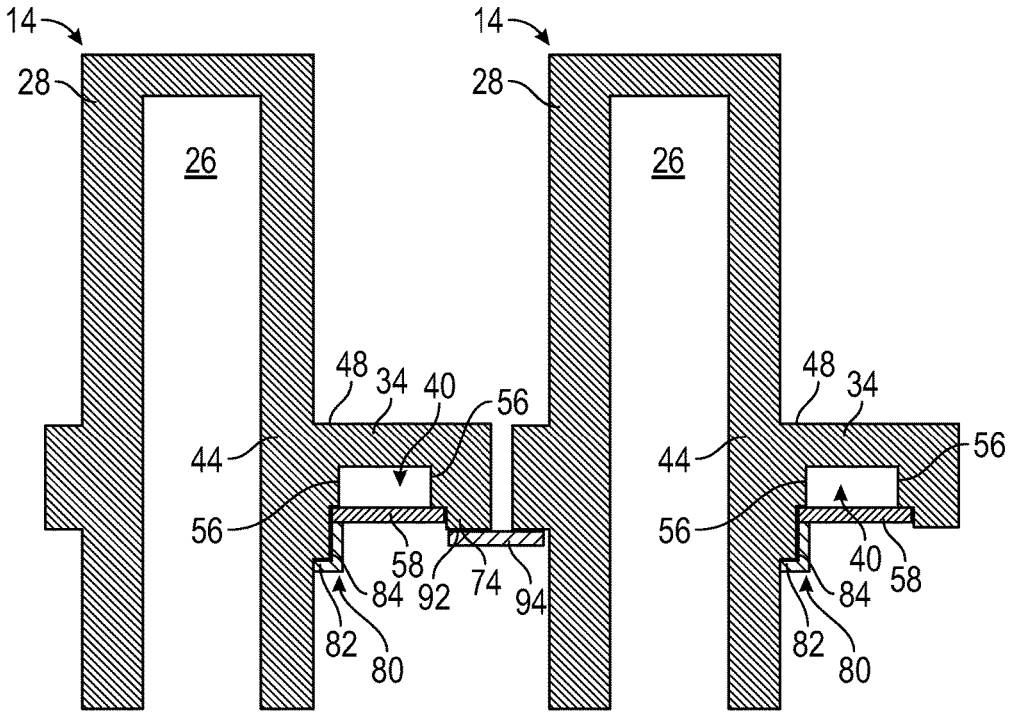
FIG. 14 is a view along lines D-D of FIG. 5B wherein the securement of two airfoils to each other in accordance with a non-limiting embodiment of the present disclosure is illustrated.

Referring now to FIG. 14 and through the implementation of various embodiments of the present disclosure, the portion of cover plate 58 that is proximate to rail 74 is secured to rib or ledge 56 at a location away from a seal land 92 of the rail 74 such that the cover plate 58 does not interfere with a blade-to-blade seal 94, which in one non-limiting embodiment may comprise a feather seal, a damper, a pin seal or any other equivalent method for sealing one blade to another. For example, and with respect to the view illustrated at least FIG. 14, the portion of cover plate 58 that is proximate to rail 74 is secured to rib or ledge 56 at a location above the seal land 92 of the rail 74 so that it does not interfere with the blade-to-blade seal 94.

By using the vertical channel 76 and/or chimney 76 as described herein along with the associated cover plates, the feed hole 42 can be located at a different location than the cooling chamber 40, where there is more access to drill the hole and the stresses are lower. In addition to moving the feed hole to a lower stress region, the chimney or channel 76 can provide more surface area to optimize the shape of the feed hole to lower stress. The use of the cover plate to create one of the walls of the chimney or channel allows access for the feed hole to be drilled and allows the chimney ribs to be a part of the wax die, eliminating the need for an expensive core.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A component for a gas turbine engine, the component comprising:

a platform secured to the component, the platform having an exterior surface in fluid communication with an internal cooling pocket of the platform via a plurality of cooling openings located in the platform;

a channel in fluid communication with the internal cooling pocket;

an internal cooling cavity in fluid communication with the channel via a feed opening extending through an internal wall of the component, wherein a portion of the channel and the feed opening are located below the internal cooling pocket; and a cover plate sealing the internal cooling pocket and the channel, wherein the cover plate comprises a first cover plate portion covering the internal cooling pocket and a second cover plate portion covering the channel.

2. The component as in claim 1, wherein the feed opening has an oblong or circular configuration.

3. The component as in claim 1, wherein the second cover plate portion has at least one "L" shaped configuration.

4. The component as in claim 1, wherein the second cover plate portion is a separate cover plate not integrally formed to the first cover plate portion.

5. A component for a gas turbine engine, the component comprising:

a platform secured to the component, the platform having an exterior surface in fluid communication with an internal cooling pocket of the platform via a plurality of cooling openings located in the platform;

a channel in fluid communication with the internal cooling pocket;

an internal cooling cavity in fluid communication with the channel via a feed opening extending through an internal wall of the component, wherein a portion of the channel and the feed opening are located below the internal cooling pocket; and a cover plate sealing the internal cooling pocket and the channel, wherein another portion of the channel is located within a ledge that is located in an internal periphery of the internal cooling pocket.

6. The component as in claim 5, wherein the cover plate is secured to the ledge.

7. The component as in claim 5, further comprising a pair of ribs extending from the ledge and wherein the portion of the channel is also located between the pair of ribs and the feed opening is located between the pair of ribs.

8. The component as in claim 7, wherein the cover plate has a first cover plate portion secured to the ledge and a second cover plate portion secured to the pair of ribs.

9. The component as in claim 5, wherein the cover plate comprises a first cover plate portion secured to the ledge and a second cover plate portion secured below the ledge.

10. The component as in claim 9, wherein the feed opening is located below the ledge and is covered by the second cover plate portion.

11. The component as in claim 10, wherein the channel is formed by the second cover plate portion.

12. The component as in claim 5, wherein the cover plate comprises a first cover plate secured to the ledge and a second cover plate secured below the ledge, wherein the second cover plate forms the another portion of the channel.

13. The component as in claim 5, wherein the channel is also located in the internal wall and wherein the cover plate comprises a first cover plate portion secured to the ledge and a second cover plate portion secured to the internal wall below the ledge.

14. A blade for a gas turbine engine, the blade comprising:

an airfoil;

a platform secured to the airfoil, the platform having an exterior surface located adjacent to the airfoil in fluid communication with an internal cooling pocket of the platform via a plurality of cooling openings located in the platform;

a channel in fluid communication with the internal cooling pocket;

an internal cooling cavity of the airfoil in fluid communication with the channel via a feed opening extending through an internal wall of the airfoil; and a cover plate sealing the internal cooling pocket and the channel, wherein cooling fluid in the internal cooling cavity must pass through the feed opening and the channel prior to entering the internal cooling pocket, wherein the cover plate comprises a first cover plate portion covering the internal cooling pocket and a second cover plate portion covering the channel, at least a portion of the channel being located below the internal cooling pocket.

15. A blade for a gas turbine engine, the blade comprising:

an airfoil;

a platform secured to the airfoil, the platform having an exterior surface located adjacent to the airfoil in fluid communication with an internal cooling pocket of the platform via a plurality of cooling openings located in the platform;

a channel in fluid communication with the internal cooling pocket;

an internal cooling cavity of the airfoil in fluid communication with the channel via a feed opening extending through an internal wall of the airfoil; and a cover plate sealing the internal cooling pocket and the channel, wherein cooling fluid in the internal cooling cavity must pass through the feed opening and the channel prior to entering the internal cooling pocket, wherein the channel is located within a ledge that is located in an internal periphery of the internal cooling pocket and the channel extends below the ledge and wherein the cover plate comprises a first cover plate portion secured to the ledge to seal the internal cooling pocket and a second cover plate portion secured below the ledge to seal the channel.

16. The blade as in claim 15, wherein the feed opening is located below the ledge and has an oblong or circular configuration, and wherein the feed opening is covered by the second cover plate portion.

17. The blade as in claim 15, wherein the first cover plate is recessed from an edge of the platform rail and wherein a blade-to-blade seal sits against the edge of the platform rail.

18. A gas turbine engine, comprising:

an airfoil;

a platform secured to the airfoil, the platform having an exterior surface located adjacent to the airfoil in fluid communication with an internal cooling pocket of the platform via a plurality of cooling openings located in the platform;

a channel in fluid communication with the internal cooling pocket;

an internal cooling cavity of the airfoil in fluid communication with the channel via a feed opening extending through an internal wall of the airfoil; and a cover plate sealing the internal cooling pocket and the channel, wherein cooling fluid in the internal cooling cavity must pass through the feed opening and the channel prior to entering the internal cooling pocket, wherein the cover plate comprises a first cover plate portion covering the internal cooling pocket and a second cover plate portion covering the channel, at least a portion of the channel being located below the internal cooling pocket.

19. A method of forming a cooling path in a blade of a gas turbine engine, the method comprising:

fluidly coupling the exterior surface of the platform to an internal cooling pocket located below the platform via a plurality of openings in the platform;

fluidly coupling the internal cooling pocket to a feed opening located in an internal wall of the blade via a channel extending through a ledge of the internal cooling pocket, wherein the feed opening is in fluid communication with an internal cooling cavity of the airfoil; and securing a cover plate to the ledge, wherein the cover plate comprises a first cover plate portion covering the internal cooling pocket and a second cover plate portion covering the channel, at least a portion of the channel being located below the internal cooling pocket.

* * * * *